US005584408A

United States Patent [19]

Orkisz

[11] Patent Number: 5,584,408

[45] Date of Patent: Dec. 17, 1996

[54] LATCHING STRUCTURE FOR FOOD CONTAINER

[75] Inventor: Rudolf P. Orkisz, Monroe, Conn.

[73] Assignee: Inline Plastics Corporation, Shelton, Conn.

[21] Appl. No.: 611,010

[22] Filed: Mar. 5, 1996

[51] Int. Cl.[6] ..... B65D 6/28

[52] U.S. Cl. ..... 220/4.23; 220/4.22; 220/334; 220/339

[58] Field of Search ..... 229/406, 407; 220/4.21, 4.22, 4.23, 315, 306, 339, 334, 521, 522

[56] References Cited

U.S. PATENT DOCUMENTS

| | | | |
|---|---|---|---|
| 2,706,065 | 4/1955 | Stone . | |
| 3,149,747 | 9/1964 | Burgess . | |
| 3,511,433 | 5/1970 | Andrews et al. . | |
| 3,545,798 | 12/1970 | Swett et al. . | |
| 3,565,146 | 2/1971 | Arnolds . | |
| 4,183,446 | 1/1980 | Davis . | |
| 4,193,496 | 3/1980 | Barratt . | |
| 4,298,133 | 11/1981 | Davis . | |
| 4,303,176 | 12/1981 | Swartzbaugh . | |
| 4,333,580 | 6/1982 | Sweigart, Jr. . | |
| 4,512,474 | 4/1985 | Harding . | |
| 4,576,330 | 3/1986 | Schepp . | |
| 4,771,934 | 9/1988 | Kalmanides . | |
| 5,046,659 | 9/1991 | Warburton . | |
| 5,092,479 | 3/1992 | Wells | 229/406 X |
| 5,169,014 | 12/1992 | Hexamer | 220/4.22 |
| 5,176,272 | 1/1993 | Ryan . | |
| 5,249,406 | 10/1993 | Kalmanides . | |

FOREIGN PATENT DOCUMENTS

| | | |
|---|---|---|
| 1117491 | 2/1982 | Canada . |
| 1418897 | 12/1973 | European Pat. Off. . |
| 1602694 | 11/1981 | European Pat. Off. . |
| 2429920 | 1/1980 | France . |
| 2118142 | 10/1983 | United Kingdom . |

*Primary Examiner*—Allan N. Shoap
*Assistant Examiner*—Robin A. Hazelton
*Attorney, Agent, or Firm*—Cummings & Lockwood

[57] ABSTRACT

Latching structure for thermoformed plastic containers for food and the like wherein the lid and base of the containers are each provided with mating male and female elongated elements where the locking takes place by interengaging S-shaped sidewalls along the longer sides of the elongated elements, and the shorter sides are spaced from each other to preclude interference during opening and closing.

5 Claims, 2 Drawing Sheets

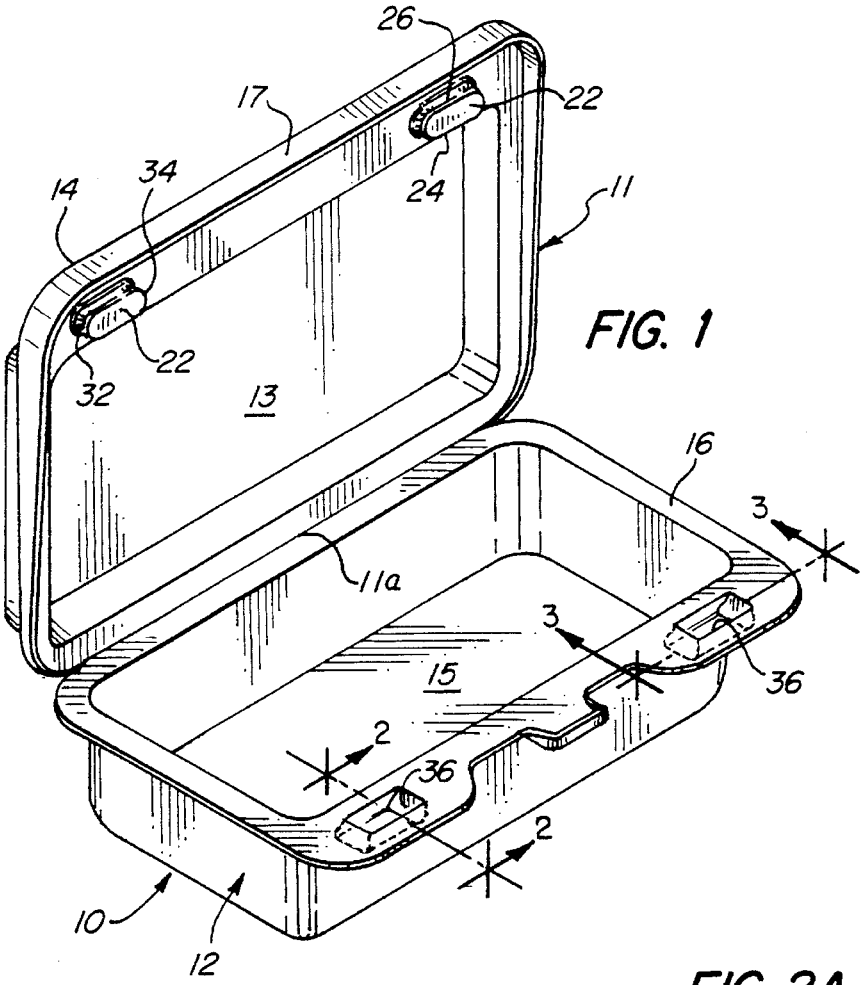
FIG. 1
FIG. 2A
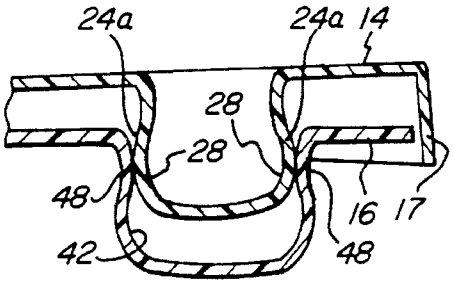
FIG. 2
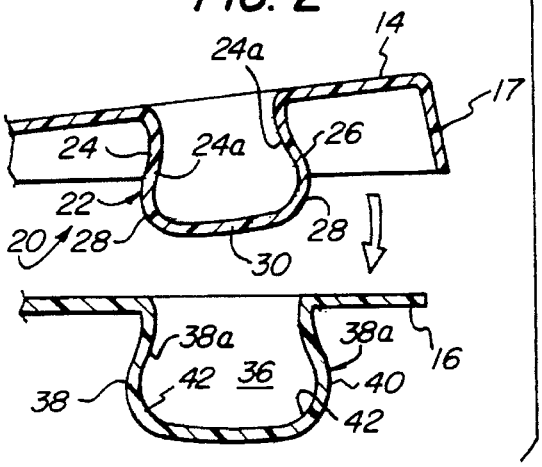
FIG. 2B
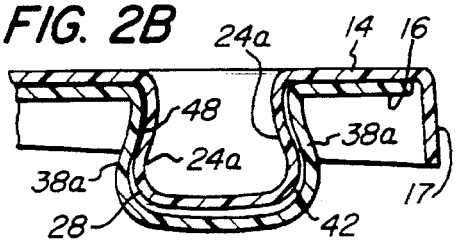

LATCHING STRUCTURE FOR FOOD CONTAINER

BACKGROUND OF THE INVENTION

1. Field of the Invention

The present invention relates to improvements in thermoformed plastic containers for food or other articles and particularly to latching structure for holding the lid and base of the container in closed condition.

2. Description of Prior Art

Containers for food or other articles thermoformed from plastic material normally comprise a lid and base which may be hinged to each other or may be separate parts. In order to hold the lid and base of the container in closed condition, it is necessary that the lid and base have latching structure which can be manually opened and closed with relative ease. However, the structure should be capable of locking the container in closed condition to avoid accidental opening.

Various types of latching or locking structures have been proposed in the past. For example, cylindrical male and female locking elements have been proposed as disclosed in U.S. Pat. No. 4,576,330. Elongated rib structures comprising cooperating male and female elements have been proposed as disclosed in British Patent Specification 1,418,897 and in Canadian Patent 1,117,491. In the prior elongated rib structure locking elements the locking action has taken place on the long sides of the ribs.

Mating male and female rib elements where the locking takes place at the shorter end or opposed sides of the ribs, rather than along the longer sides of the ribs is disclosed in U.S. Pat. No. 5,046,659. It is claimed that this permits the latching structure to be located at a variety of locations on the container and provides for latching action while permitting ease of manual operation in opening and closing the latching structure on the container.

However, the rectangular nature of the cross-section of the male and female locking elements still makes it difficult to repeatedly open and close the latch, although locking takes place along opposite sides or ends only, since the close proximity of the unlatched sides when the latch is engaged causes adhesion by friction or even an interference fit when close tolerances are not observed during production.

Further, the sharp and well defined locking elements or ribs which interengage are difficult, if not impossible, to manufacture in a thermoforming process, substantially increasing the cost of production.

If one could form latches as distinct as what is disclosed in the '659 patent, subsequent stripping of the formed part, out of the mold, would be difficult if not impossible. The mechanism would be sophisticated and more expensive than what is presently in use for part stripping, as any sharp well-defined corners in the mold and formed latch would tend to adhere without some type of mechanical separation. This would result in a more expensive production tool. Further, depending on the exact mechanism designed to accomplish the stripping, the stripping action could adversely affect the cycle time (i.e., increase it). Forming the well defined, distinct shoulders disclosed in the '659 patent would likely require a longer cycle time than what is presently in use. The plastic would need to be heated more, and the pressure form dwell would likely need to increase. Again, all these factors lead to increased production costs. Cycle time increases would result in more machine time (i.e., station) and labor expense for each container. As indicated, another issue is whether or not the '659 structure can even be manufactured, i.e., whether a mold could even be configured to provide the resultant product having sharply defined corners and undercuts. The fluid material would tend to flow around the sharp corners of the mold, forming arcuate surfaces.

SUMMARY OF THE INVENTION

It is an object of the present invention to overcome the deficiencies of the prior art in providing a latching structure for a container which is easier to operate in opening and closing the latching structure of the container, while holding production costs to a minimum.

In accordance with the present invention there is provided a container for food or other articles comprising a lid having a horizontal flange extending around the periphery thereof and a base having a horizontal flange extending around the periphery thereof adapted for engagement with the horizontal flange of the lid when the container is in closed condition. Latching structure is provided for latching the lid to the base. The latching structure includes at least one male rib having a substantially rectangular cross-section depending from the horizontal flange of the lid, the opposed longer sides of the rib having outwardly extending shoulder structure formed by a substantially, S-shaped side wall forming a protuberance adjacent its juncture with the bottom wall and the shorter sides of the rib being substantially ovular or arcuate in shape. At least one female recess having a substantially rectangular cross-section is located in the flange of the base and dimensioned to receive a cooperating male rib in the lid. The opposite longer sides of the female recess are also formed with a substantially S-shaped sidewall forming an outwardly extending recess adapted to mate with the outwardly extending protuberance of the male rib in the lid and the shorter sides of the female recess are substantially straight. The S-shaped walls of the male rib and the corresponding side walls of the female recess are constructed and arranged to deflect with respect to each other so that when the male rib is pressed into the female recess the protuberance on the male will snap into position into the recess in the female and interlock therewith to latch the lid securely to the base. The ovular short sides of the male are sufficiently spaced from the straight short sides of the female recess so as not to interfere therewith enabling ready reopening and reclosing of the container lid.

The geometry of the lock (latch) is developed by a smooth, continuous radius (i.e., the "S" shaped side wall) rather than distinct corners or shoulders that are formed by the intersection of two straight surfaces. The smooth continuous radius results in better material flow down into the mold for forming the female element. This material flow provides for easier forming of the lock and a stronger (thicker walled) female element, as more material makes its way down into the female element, which in turn makes it stronger. The easier forming also results in a decrease in cycle time.

Further objects and advantages of the present invention will become apparent from the following description and claims and from the accompanying drawings, wherein:

BRIEF DESCRIPTION OF THE DRAWINGS

FIG. 1 is a perspective view of a container for food or other articles embodying the present invention showing a lid hinged to a base and latching structure for latching the lid to the base in closed position;

FIG. 2 is an exploded cross-sectional view taken along the lines 2—2 in FIG. 1 showing the latch elements of the container about to be engaged;

FIG. 2A is a sectional view similar to FIG. 2 showing the elements partially engaged;

FIG. 2B is a sectional view similar to FIG. 2 showing the latch elements fully engaged;

DETAILED DESCRIPTION OF THE PREFERRED EMBODIMENT

Figure 3:
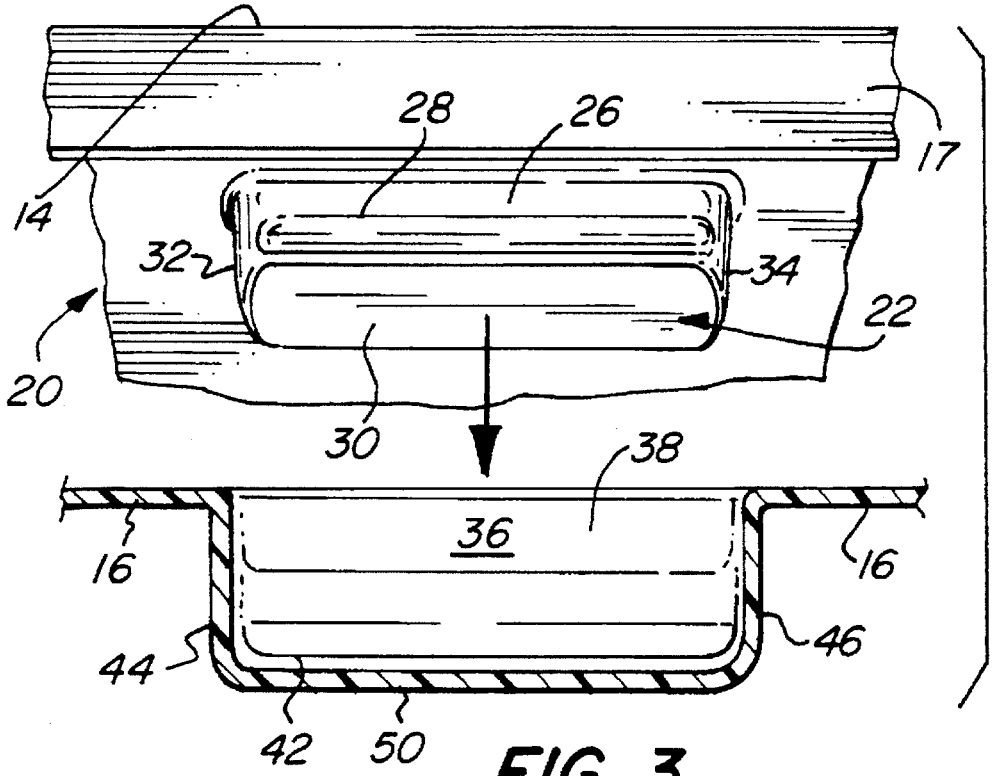
FIG. 3 is an exploded sectional view taken along the lines 3—3 in FIG. 1, showing the latch elements about to be engaged.

Referring now to the drawings in detail, wherein like numerals indicate like elements throughout the several views, there is shown in FIG. 1 a plastic container 10 embodying the present invention. The container 10 is designed to be thermoformed from a suitable plastic material. One clear plastic material which is particularly suitable is oriented polystyrene (O.P.S.). Of course, other thermoformed plastic materials may be used depending upon the end use of the containers. The container 10 is particularly adapted for use in holding food or other articles and includes a lid 11 hinged at the rear along a line 11*a* to a base 12. The lid 11 includes a central dome portion 13 having a horizontal flange 14 extending around the periphery thereof. The base 12 includes a central receptacle portion 15 having a horizontal flange 16 extending around the periphery thereof. The flange 14 on the lid 11 is provided with a depending rim 17 at the front of the lid opposite the hinge line 11*a*. The rim 17 tapers from a maximum vertical dimension along the front end of the lid to a minimum along the sides as it approaches the hinge 11*a*. This is clearly shown in FIG. 1 of the drawing. The horizontal flange 14 on the lid 11 is adapted for engagement with the horizontal flange 16 on the base 12 when the container 10 is in closed condition.

The container 10 shown in FIG. 1 is provided with latching structure (shown in FIG. 2) 20 for latching the lid 11 to the base 12 as now to be described. The latching structure 20 includes at least one male rib 22 having a substantially rectangular cross-section depending from the horizontal flange 14 of the lid 11, the opposite longer sides 24, 26 of the rib 22 having outwardly extending shoulder structure formed by a substantially, S-shaped side wall 24*a* forming a protuberance 28 adjacent its juncture with the bottom wall 30 and the shorter sides 32, 34 of the rib being substantially ovular or arcuate in shape. At least one female recess 36 which is also substantially rectangular in cross-section is located in the flange 16 of the base 12 and dimensioned to receive a cooperating male rib 22 in the lid 11. The opposite longer sides 38, 40 of the female recess 36 are also formed with a substantially S-shaped sidewall 38*a* forming an outwardly extending recess 42 adapted to mate with the outwardly extending protuberance 28 of the male rib 22 in the lid 11 and the shorter sides 44, 46 of the female recess are substantially straight.

The walls 24*a* of the male rib 22 and the corresponding side walls 38*a* of the female recess 36 are constructed and arranged to deflect with respect to each other as illustrated in FIG. 2A so that when the male rib 22 is pressed into the female recess 36 the protuberance 28 on the male 22 will snap into position into the recess 42 in the female 36 as shown in FIG. 2B and interlock therewith to latch the lid 11 securely to the base 12. The ovular or arctare short sides 32, 34 of the male rib 22 are sufficiently spaced from the straight short sides 44, 46 (see FIG. 3A) of the female recess 36 so as not to interfere therewith enabling ready reopening and reclosing of the container lid 11.

Figure 3A:
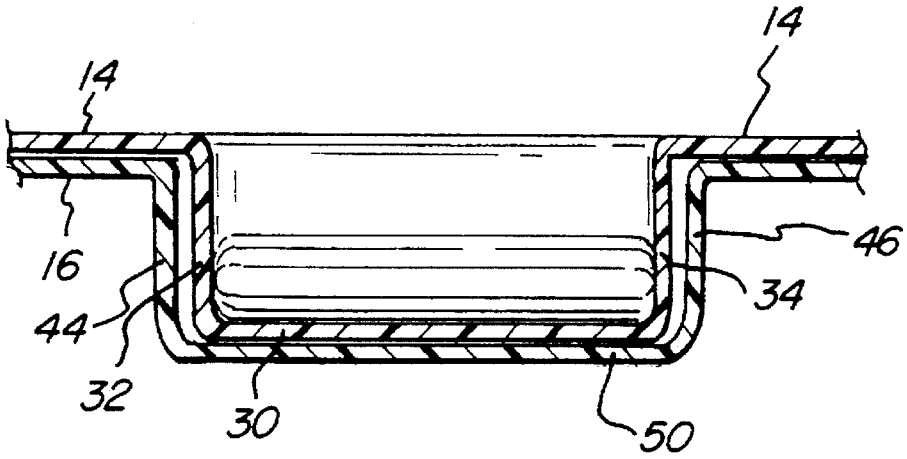
FIG. 3A is a sectional view similar to FIG. 3 showing the latch elements in closed condition, fully engaged.

When the lid 11 of the container moves from the open condition in FIGS. 1, 2 and 3 to the closed condition of FIGS. 2A, 2B and 3A, respectively, the latching structure 20 including the rib 22 moves from the position in FIGS. 2 and 3 to the closed or latched position shown in FIGS. 2B and 3A, respectively. During this movement the protuberance 28 on the male rib 22 engages the surface 48 on the female recess 36 causing the surface 48 to move outwardly to permit the protuberance 28 on the male rib 22 to move into recess 42 in the female recess 36, thus bringing the surface 28 into engagement with the recess 42 and the interior of S-shaped side wall 38*a*. This is clearly illustrated in FIG. 2B. When the container 10 and latching structure 20 are in closed condition as shown in FIGS. 3 and 3A, the bottom wall 30 of the male rib 22 will be close to engagement with the bottom wall 50 of the female recess 36, with the shorter sides 32, 34 of the male rib 22 spaced from the shorter sides 44, 46, respectively of the female recess 36 to preclude interference during opening and reclosing of the container lid 11. The horizontal flange 14 on the lid 11 likewise will be in engagement with the horizontal flange 16 on the base 12 and will be held in engagement by the latching structure 20 described above.

As may be seen in FIGS. 1 and 3 the width of the opposite ends or shorter sides 32, 34 of the male rib 22 are relatively short and ovular in shape as compared to the length of the sides 24, 26. This permits the latching structure comprising the elements 22 and 36 to be relatively easily closed and opened to effect latching engagement and disengagement as the relatively short and ovular sides 32, 34 of the male rib 36 are spaced from the straight short sides 44, 46 of the female recess 36 to preclude interfering or frictional contact, assuring only latching on the opposed longer sides of the elements.

What is claimed as new is as follows:

1. A container for food or other articles comprising: a lid having a horizontal flange extending around the periphery thereof, a base having a front and a rear and a horizontal flange extending around the periphery thereof and engageable with the horizontal flange of said lid when said container is in closed condition, means for latching the front of said lid to said base, said latching means including:

at least one male rib having an oblong cross-section depending from said horizontal flange of said lid, opposite sides of said rib having an S-shaped sidewall forming a protuberance adjacent a bottom wall thereof, the remaining sides of said rib being arcuate, at least one female recess having a rectangular cross-section formed in said flange of said base dimensioned to receive a cooperating male rib in said lid, opposite sides of said female recess having an S-shaped side wall forming an outwardly extending recess matable with said protuberance of said male rib in said lid, the remaining sides of said female recess being straight and spaced from the arcuate sides of the male rib when the rib is received within said recess, the contacting sides of said male rib and said female recess being constructed and arranged to deflect with respect to each other so that when said male rib is pressed into said female recess the protuberance on said male rib will snap into position into the outwardly extending recess in the sidewall of said female recess and interlock therewith to latch said lid to said base.

2. A container according to claim 1 wherein said lid is hinged to the rear of said base for movement towards and away from said base to open and close said container and said latching means is located at the front of said base.

3. A container according to claim 1 wherein said lid includes a central dome structure extending upwardly from said horizontal flange extending around the periphery thereof, and said base includes a central receptacle structure depending from said horizontal flange extending around the periphery thereof.

4. A container according to claim 1 wherein the S-shaped sidewalls forming the protuberance on said male rib is on the longer side of said rib and the corresponding outwardly extending recess in the female recess is on the longer side of the female recess.

5. A container according to claim 1 wherein the arcuate surfaces on the sidewalls of the male rib are on the opposite, shorter sides of the male rib.

* * * * *